United States Patent [19]

Ray et al.

[11] 4,379,720

[45] Apr. 12, 1983

[54] NICKEL-ALUMINUM-BORON POWDERS PREPARED BY A RAPID SOLIDIFICATION PROCESS

[75] Inventors: Ranjan Ray, Burlington; Viswanathan Panchanathan, North Billerica, both of Mass.

[73] Assignee: Marko Materials, Inc., North Billerica, Mass.

[21] Appl. No.: 358,235

[22] Filed: Mar. 15, 1982

[51] Int. Cl.[3] ..... B22F 1/04

[52] U.S. Cl. ..... 75/251; 148/428; 148/442; 420/460; 420/581

[58] Field of Search ..... 75/0.5R, 0.5 BA, 134 F, 75/134 P, 170, 171, 251–255; 148/428, 442; 420/441, 460, 580, 581

[56] References Cited

U.S. PATENT DOCUMENTS

| | | | |
|---|---|---|---|
| 2,910,356 | 10/1959 | Grala et al. | 75/170 |
| 3,338,688 | 8/1967 | Longo | 75/251 |
| 3,856,513 | 12/1974 | Chen et al. | 75/171 |
| 4,197,146 | 4/1980 | Frischmann | 75/251 |
| 4,290,808 | 9/1981 | Ray | 75/251 |

FOREIGN PATENT DOCUMENTS 26871 4/1981 European Pat. Off. .

OTHER PUBLICATIONS

Stadelmaier, H., et al. "Die Nickelecke des ternären Systems Ni–A1–B" *Metall,* vol. 6, pp. 212–214 (1962).

Schöbel, von Joachim, et al.; "Metallsphärolithen ion System Nickel–Aluminum–Bor;" Z. Metallkele, pp. 326–328 (1962).

*Primary Examiner*—Michael L. Lewis

[57] ABSTRACT

Nickel-aluminum alloys containing boron in powder form are disclosed. These alloys are subjected to melt-spinning to form a brittle filament consisting in large measure of a metastable solid solution phase. This is then pulverized to powder configuration. Such powders exhibit excellent sprayability to form a dense, homogeneous, hard coating on a metallic substrate. The alloys, also exhibit excellent resistance to high temperature oxidation.

3 Claims, No Drawings

NICKEL-ALUMINUM-BORON POWDERS PREPARED BY A RAPID SOLIDIFICATION PROCESS

BACKGROUND OF THE INVENTION

This invention relates to nickel-aluminum-boron powders and more particularly to such powders having excellent capability to produce a dense structurally strong coating with excellent resistance to wear, oxidation, and corrosion.

DESCRIPTION OF THE PRIOR ART

Metal powders are well-known in the art and widely used. They can be deposited as a coating on a base metal by various spray techniques, e.g. flame spray and plasma spray. A dense, well-bonded coating of suitable chemical composition, structures, and properties deposited onto a relatively inexpensive base metal is useful to economically extend the service life of a product made of the base metal where such a product is subjected to corrosive and oxidizing media in service conditions.

Spray metal powders are also used to produce dense, hard, high structural strength coatings for resistance against various kinds of wear e.g. abrasive, sliding, fretting, etc.

The spray coatings are also suited for dimensional restoration of worn parts.

The present invention relates to boron-containing nickel-aluminum alloys produced as powders by a rapid solidification process wherein such powders are characterized by (a) a high degree of compositional uniformity, (b) excellent sprayability i.e. ability to form a dense, hard coating with high interfacial bond strength between the coating and the substrate, (c) high hardness, and (d) excellent resistance to various hot corrosive media.

Several techniques are well-known in the art to economically fabricate rapidly solidified alloys. One well-known example is melt-spin chill casting whereby metal is spread as a thin layer on a conductive metallic substrate moving at a high speed to form a rapidly solidified ribbon.

Many alloy compositions are well-known in the art based on transition metals containing large amounts of metalloid elements e.g. boron, carbon, phosphorous, or silicon wherein such alloys when subjected to rapid solidification processing by the method of melt-spinning form ribbons which possess high ductility, strength, and hardness (ref. to U.S. Pat. No. 3,856,513 and U.S. Pat. No. 3,986,867).

SUMMARY OF THE INVENTION

This invention features nickel-aluminum-boron alloys prepared by a rapid solidification processing method in powder form characterized by homogeneous, ultrafine crystalline structure, excellent sprayability to form a dense, well-bonded coating on a metallic substrate and having high hardness and excellent resistance to various corrosive and oxidizing media.

Alloy compositions are categorized as given below:

$$Ni_{40-58}Al_{30-40}B_{12-20}$$

wherein the subscripts are in atom percent; Ni, Al, and B are nickel, aluminum, and boron respectively;

wherein the total content of Ni, Al, and B must be equal to 100.

Using the method melt-spin-chill casting, the alloys of the above formulae are subjected to rapid solidification processing (i.e. processing in which the liquid alloy is subjected to cooling rates on the order of $10^5$ to $10^7$° C./second) whereby they form brittle ribbons. The rapidly solidified ribbons of such alloys having high hardness values, 800–1100 Kg/mm$^2$, are readily pulverized by the standard technique of hammer milling, etc. into powders under 80 mesh and preferably under 170 mesh suitable for application as spray coating.

DETAILED DESCRIPTION OF THE INVENTION

In accordance with the present invention nickel-aluminum alloys are further alloyed with 12–20 atoms percent of boron. The alloys may also contain limited amounts of the elements which are found in commercial nickel-base alloys without changing the essential behavior of the alloys. Typical examples include $Ni_{40}Al_{40}B_{20}$, $Ni_{45}Al_{40}B_{15}$, and $Ni_{48}Al_{35}B_{17}$.

The alloys of the present invention upon rapid solidification processing from the melt by melt-spin-chill casting at cooling rates on the order of $10^5$ to $10^7$° C./second, form brittle ribbons consisting of a high degree of compositional uniformity. The brittle ribbons are readily pulverized into powders using standard comminution techniques e.g. a rotating hammer mill. Powders typically have an average particle size of less than 80 mesh (U.S. Standard), preferably less than 170 mesh (U.S. Standard) comprising platelets having an average thickness of less than 0.1 mm and each platelet being characterized by an irregular shape resulting from fracture of the solidified material. The powders prepared by fracture of hard, brittle melt-spun ribbons are characterized by a smooth edge and surface. The hard, non-deformable powders, because of their shape characteristics exhibit excellent free-flowing characteristics. The smooth surfaces and edges of the particles also prevent agglomeration or interlocking of the particles. The above characteristics of the powders of the present invention enable their smooth and uniform flow aided by a carrier gas from a powder feed unit to the plasma flame through a nozzle. Uniform flow of powders through the plasma flame is essential for consistent sprayability of "spray" powders. During the process of spraying these crystalline powders, a fairly even distribution of particles throughout the cross-section of the spray stream is achieved so that sprayed material becomes evenly distributed on the substrate being coated and that there are no gaps between passes of the spray stream.

The present rapidly solidified powders of nickel-aluminum-boron alloys exhibited capability to form excellent, dense and homogeneous coatings by the plasma flame spraying technique. Such coatings have high macro-hardness between 80–83 on $R_n15$ scale in as-sprayed condition. For example, a coating made by plasma spraying of rapidly solidified nickel-aluminum-boron powders on a mild steel plate had a microhardness of 83 on the $R_n15$ scale. Such high hardness of the coating will make them suitable for various applications involving sliding wear, fretting wear, hard particle erosion, and the like. These powders form a very dense, extremely well-bonded coating. The coatings of these powders have high strength. Typically, the tensile strength of the coating averaged around 8000 psi. Many commercial coatings made by plasma spraying mixtures of tungsten carbide and cobalt powders intended for wear resistant applications typically have macrohardness in the 74–84 range of the $R_n15$ scale (see, Handbook on Plasma Spray Materials by Bay State Abrasives, Dresser Industries, Westboro, Mass.). However, wear-resistant applications of tungsten carbide spray coatings are limited to low operating temperatures, such as under 1000° F., (540° C.). For many applicatons, e.g. in aerospace industry at high operating temperature, such as above 1000° F., tungsten carbide coatings are unsuitable because of their poor high temperature oxidation resistance. Coatings made of commercial titanium-carbide and chromium carbide powders mixed with nickel powders have the capability of operating at higher temperatures, reaching 1500° F. (815° C.); however, these coatings have lower hardness values, e.g. 70–82 on the $R_n15$ scale.

The boron content of the present alloys range between 12 to 20 atom percent. With the boron content over 20 percent, the alloys produce brittle coatings. At metalloid contents below 12 percent, the alloys are difficult to form as rapidly solidified ribbons by the method of melt deposition on a rotating chill substrate i.e. melt-spinning. This is due to the inability of the melts with low metalloid content to form a stable molten pool on the quench surface, as necessary to form rapidly solidified ribbons by the melt-spinning procedure. Furthermore, at low contents of metalloid, the alloys produced sprayed coatings of less desirable hardness and strength. Superior mechanical properties, excellent high temperature oxidation and corrosion resistance, high hardness and excellent sprayability of the present rapidly solidified nickel-aluminum-boron alloy powders will make them suitable for many applications as sprayed coatings requiring good oxidation, corrosion, and wear resistance.

The as-sprayed coating made with the present nickel-aluminum-boron powders of exhibited high hardness and excellent resistance to oxidation and structural degradation upon exposure to high temperatures, reaching 1500° to 1700° F. (815°–930° C.) Such coatings will be useful in wear resistant applications at high operating temperatures which may exceed 1500° F.

EXAMPLES 1–5

A number of alloys having compositions within the scope of the invention, as given in Table 1, were fabricated as ribbons having the thicknesses of ~0.001–0.003 inches by the melt-spinning-chill casting method using a rotating Cu-Be cylinder having a quench surface speed of ~5000 ft/minute. The alloys were found to have excellent ribbon fabricability. The ribbons were found by Xray diffraction analysis to consist predominantly of a single solid solution phase. The as-quenched ribbons were found to be quite brittle to bending, being amenable to ready comminution to powder. The as-quenched ribbons exhibited high microhardness values ranging between 800 to 1100 Kg/mm$^2$ (see Table 1).

TABLE 1

| Example | Alloy Composition (atom percent) | Hardness (Kg/mm$^2$) |
|---|---|---|
| 1 | $Ni_{40}Al_{40}B_{20}$ | 950 |
| 2 | $Ni_{45}Al_{37}B_{18}$ | 1020 |
| 3 | $Ni_{50}Al_{30}B_{20}$ | 1004 |
| 4 | $Ni_{55}Al_{32}B_{13}$ | 810 |

TABLE 1-continued

| Example | Alloy Composition (atom percent) | Hardness (Kg/mm$^2$) |
|---|---|---|
| 5 | $Ni_{52}Al_{36}B_{12}$ | 966 |

EXAMPLES 6–7

Two alloys having compositions $Ni_{45}Al_{37}B_{18}$ and $Ni_{50}Al_{35}B_{15}$ were prepared into rapidly solidified powders by pulverization of brittle, rapidly solidified melt-spun ribbons. The powders had a particle size ranging between −170 mesh to +325 mesh. The powders were plasma sprayed on the surface of mild steel plate grit blasted with alumina. The spray parameters used are given in Table 2 below.

TABLE 2

| | |
|---|---|
| Working Gas: | Argon |
| Working Gas Flow: | 40% at 50 psig |
| Powder Gas Flow: | 15% at 50 psig |
| Powder Feed Rate: | 6.1 pounds/hour |
| Deposition Rate: | 4.5 pounds/hour |
| Arc Current: | 700 Amperes |
| Arc Voltage: | 30 volts |

Plasma sprayed coatings produced with the above powders have a dense coating with a homogeneous structure. The coatings also exhibited high hardness values ranging between 80–83 on the $R_n15$ scale.

EXAMPLE 8

The tensile strength of a plasma sprayed coating 0.006–0.008 thick having the composition $Ni_{45}Al_{37}B_{18}$ (atom percent) was measured and indicated as average value of 8200 psi.

EXAMPLE 9

A mild steel coupon was coated on all sides by plasma spray deposition technique with a 0.020" thick coating of an alloy, $Ni_{45}Al_{37}B_{18}$. The coated coupon was exposed to 1700° F. for 100 hours. The coating exhibited excellent resistance to oxidation and spalling.

Having thus described the invention, what we claim and desire to obtain by Letters Patent of the United States is:

1. A metallic alloy in powder form with particle size below 4 mesh (U.S. Standard), and having the composition described by the formula:

$$Ni_{40\text{-}58}Al_{30\text{-}40}B_{12\text{-}20}$$

wherein Ni, Al, and B are nickel, aluminum, and boron respectively and wherein the subscripts are in atom percent and the total content of Ni, Al, and B is 100; wherein said alloy being prepared by the method comprising the steps:

(a) forming a melt of said alloy (b) depositing said melt against a rapidly moving quench surface adapted to quench said melt at a rate in the range of approximately $10^5$ to $10^7$ °C./second and form thereby a rapidly solidified brittle strip of said alloys characterized by hardness values between 800 and 1100 Kg/mm$^2$ (c) comminuting said strip into powders.

2. The alloys of claim 1 in powder form wherein said powders have average particle size of less than 60 mesh (U.S. Standard) comprising platelets having an average thickness of less than 0.1 mm and each platelet being chacterized by an irregularly shaped outline resulting from fracture thereof.

3. The alloy of claim 1 in powder form, wherein said powders have particle size below 325 mesh (U.S. Standard).

* * * * *